US010231559B2

(12) United States Patent
Bacallao et al.

(10) Patent No.: US 10,231,559 B2
(45) Date of Patent: Mar. 19, 2019

(54) CHECKOUT STATION WITH HANGER HOOK

(71) Applicant: Walmart Apollo, LLC, Bentonville, AR (US)

(72) Inventors: Yurgis Mauro Bacallao, Centerton, AR (US); Michael D. Bookman, Suwanee, GA (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/875,314

(22) Filed: Jan. 19, 2018

(65) Prior Publication Data

US 2018/0220813 A1 Aug. 9, 2018

Related U.S. Application Data

(60) Provisional application No. 62/456,403, filed on Feb. 8, 2017.

(51) Int. Cl.
*A47F 7/19* (2006.01)
*A47F 7/24* (2006.01)
(Continued)

(52) U.S. Cl.
CPC ..... *A47F 9/02* (2013.01); *A47F 7/00* (2013.01); *A47F 9/04* (2013.01); *A47G 25/1442* (2013.01);
(Continued)

(58) Field of Classification Search
CPC .. A47F 5/0006; A47F 5/01; A47F 7/19; A47F 7/24; A47F 2009/041;
(Continued)

(56) References Cited

U.S. PATENT DOCUMENTS 3,217,893 A * 11/1965 Fleischman ..... A47F 7/24 211/182
4,452,360 A 6/1984 Barnes
(Continued)

OTHER PUBLICATIONS

"Copper Pipe Toilet Paper Holder," Kristimurphy.com, Apr. 21, 2013, (9 pages).
(Continued)

*Primary Examiner* — Mark J Beauchaine
(74) *Attorney, Agent, or Firm* — Schmeiser, Olson & Watts LLP

(57) ABSTRACT

Described is a checkout station that includes a hanger hook coupled to a platform. The hanger hook is used to hang empty clothes hangers on, so the hangers can be collected and held in one location until they are re-used or disposed of. The hanger hook can be a U-shaped elongate member with a curved bottom piece, a first side, and a second side. The first side and the second side are each coupled to the bottom piece to form the "U" shape. The first side couples to the register stand, and hangers are hung from the second side. Having the hanger hook at the checkout station makes it easy for employees and customers to hang empty hangers on the hanger hook so the hangers are collected and do not end up on the floor or cluttering the work spaces of the checkout station.

8 Claims, 5 Drawing Sheets

(51) Int. Cl.

| | |
|---|---|
| ***A47F 9/02*** | (2006.01) |
| ***G07G 1/00*** | (2006.01) |
| ***A47F 7/00*** | (2006.01) |
| ***A47F 9/04*** | (2006.01) |
| ***A47G 25/14*** | (2006.01) |

(52) U.S. Cl.
CPC ..... *A47G 25/1464* (2013.01); *G07G 1/0018* (2013.01); *A47F 2009/041* (2013.01)

(58) Field of Classification Search
CPC .. A47B 61/003; A47G 25/06; A47G 25/0692; A47G 25/1457
See application file for complete search history.

(56) References Cited

U.S. PATENT DOCUMENTS 6,196,398 B1 * 3/2001 Lowe ..... A47B 61/003 211/87.01
7,426,997 B2 9/2008 Nagelski
8,875,961 B1 * 11/2014 Watson ..... A47G 25/0614 223/85
2003/0098250 A1 * 5/2003 Sabounjian ..... A47B 43/04 206/298
2009/0288917 A1 * 11/2009 Sato ..... A47F 9/045 186/62

OTHER PUBLICATIONS

"Paper holder for toilet paper, made of stainless steel, model Doppel-Pfosten10 without base plate," Stahldeko-Shop.com, accessed Nov. 24, 2016, (2 pages).
"Kayak Hanger," https://i.pinimg.com/736x/21/e1/1f/21e11fc0d466732412240dca8f4c9453.jpg, accessed Nov. 24, 2016, (1 page).
"DuctStore," DuctStore.co.uk, accessed Nov. 24, 2016, (8 pages).
"Explore Pipe Clamps, Plumbing Pipe, and more!" Pinterest.com, accessed Nov. 24, 2016, (2 pages).
"12.2.4 Manometer," Uq.edu.au, accessed Nov. 24, 2016, (1 page).

* cited by examiner

CHECKOUT STATION WITH HANGER HOOK

CROSS REFERENCE TO RELATED APPLICATION

This invention claims priority to U.S. provisional patent application Ser. No. 62/456,403, filed Feb. 8, 2017 to Applicant Wal-Mart Stores Inc., and entitled "Checkout Station with Hanger Hook", which is incorporated entirely herein by reference.

BACKGROUND OF THE INVENTION

Technical Field

This invention relates to checkout stations in retail stores, specifically, to a checkout station with a hook for receiving hangers.

State of the Art

Checkout stations are locations in a retail store where customers can pay for and bag their purchased items. Checkout stations can be run by an employee of the retail store, or they can be self-checkout stations where the customer performs the checkout tasks themselves. Products such as clothing are often hung on hangers in the retail store. If the hangers are not taken by the customer, then the products are removed from the hangers at the checkout station, and the hangers left behind. Hangers that are left behind by the customer can clutter up register space or fall on the ground, leaving a messy and dangerous area.

Accordingly, what is needed is a device for storing hangers at a checkout station, which is convenient for both customers and employees to use.

DETAILED DESCRIPTION OF EMBODIMENTS OF THE INVENTION

As discussed above, embodiments of the present invention relate to checkout stations in retail stores, specifically, to a checkout station with a hook for holding hangers.

When products are brought to a checkout station in a retail store to be paid for and bagged, some of the items, such as clothes, for example, may need to be removed from their hanger and the hanger left at the checkout station. What is needed is a device for holding the empty clothes hangers or other types of hangers at the checkout station. Disclosed is a checkout station that includes a register stand, a platform coupled to the register stand, and a hanger hook coupled to the platform. Empty clothes hangers, or other hangers, are hung on the hanger hook to store the hangers. The hanger hook holds the hangers until they are collected and re-used or disposed of. The hanger hook is in a convenient location at the checkout station so that both employees who are working at the checkout station, and customers who are performing their own checkout duties, can find and use the hanger hook to hang the empty hangers on. Customers can easily remove the clothes from the hanger, hang the empty hanger on the hanger hook, and put the clothes in their bag for removal from the store. Cashiers or other employees checking out customers at the checkout station can easily remove the clothes or other items from the hanger, and hang the hanger on the hanger hook. In some embodiments, the hanger hook is a U hook—a U-shaped hook with a first side, a second side, and a bottom piece connecting the first side to the second side. The first side couples to the register stand, and hangers are hung from the second side. Having the U hook at the checkout station makes it easy for employees and customers to hang empty hangers on the U hook so the hangers are collected and do not end up on the floor or cluttering the work spaces of the checkout station.

Figure 1:
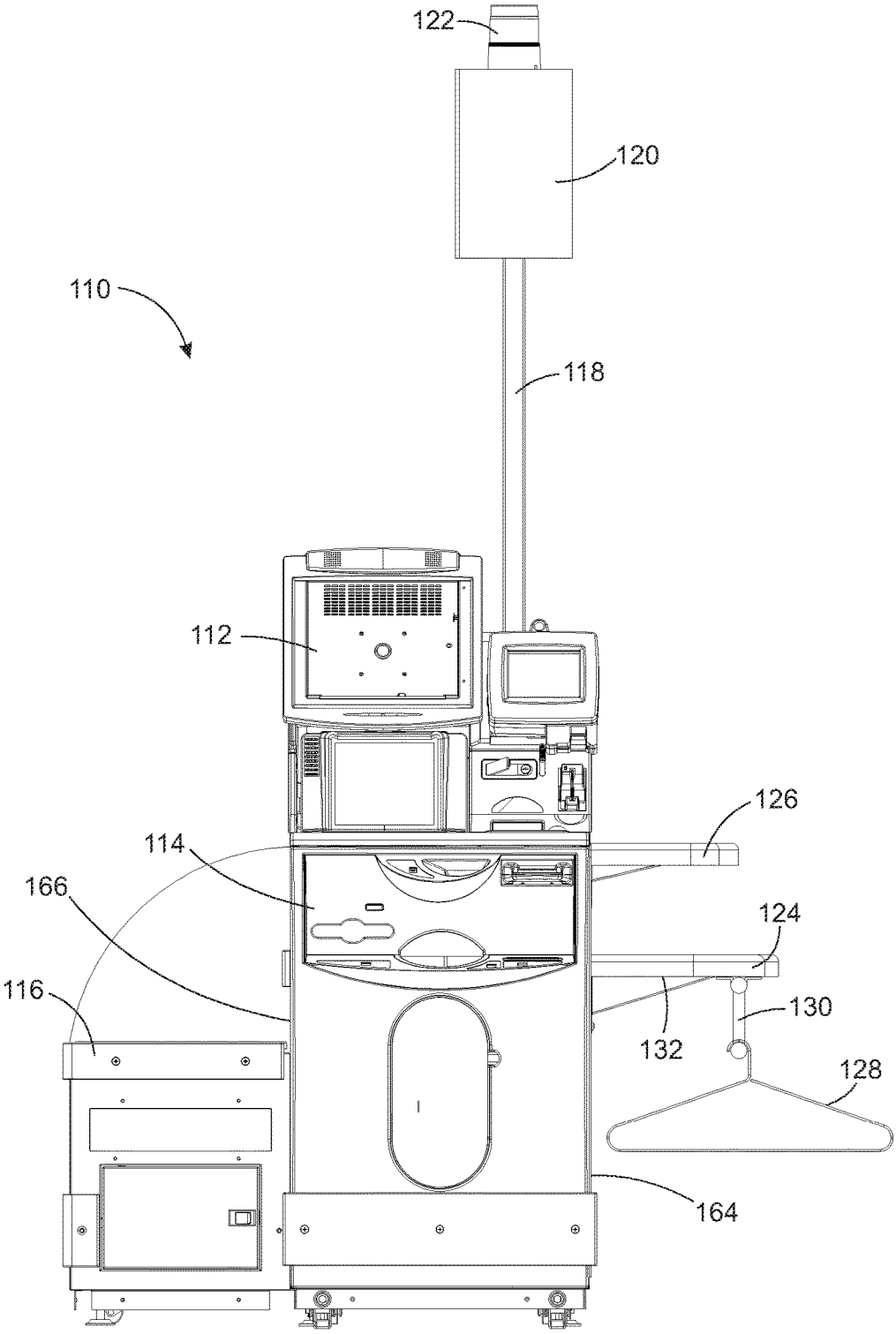
FIG. 1 shows a front view of an embodiment of a checkout station that includes an embodiment of a hook for receiving hangers.
Figure 2:
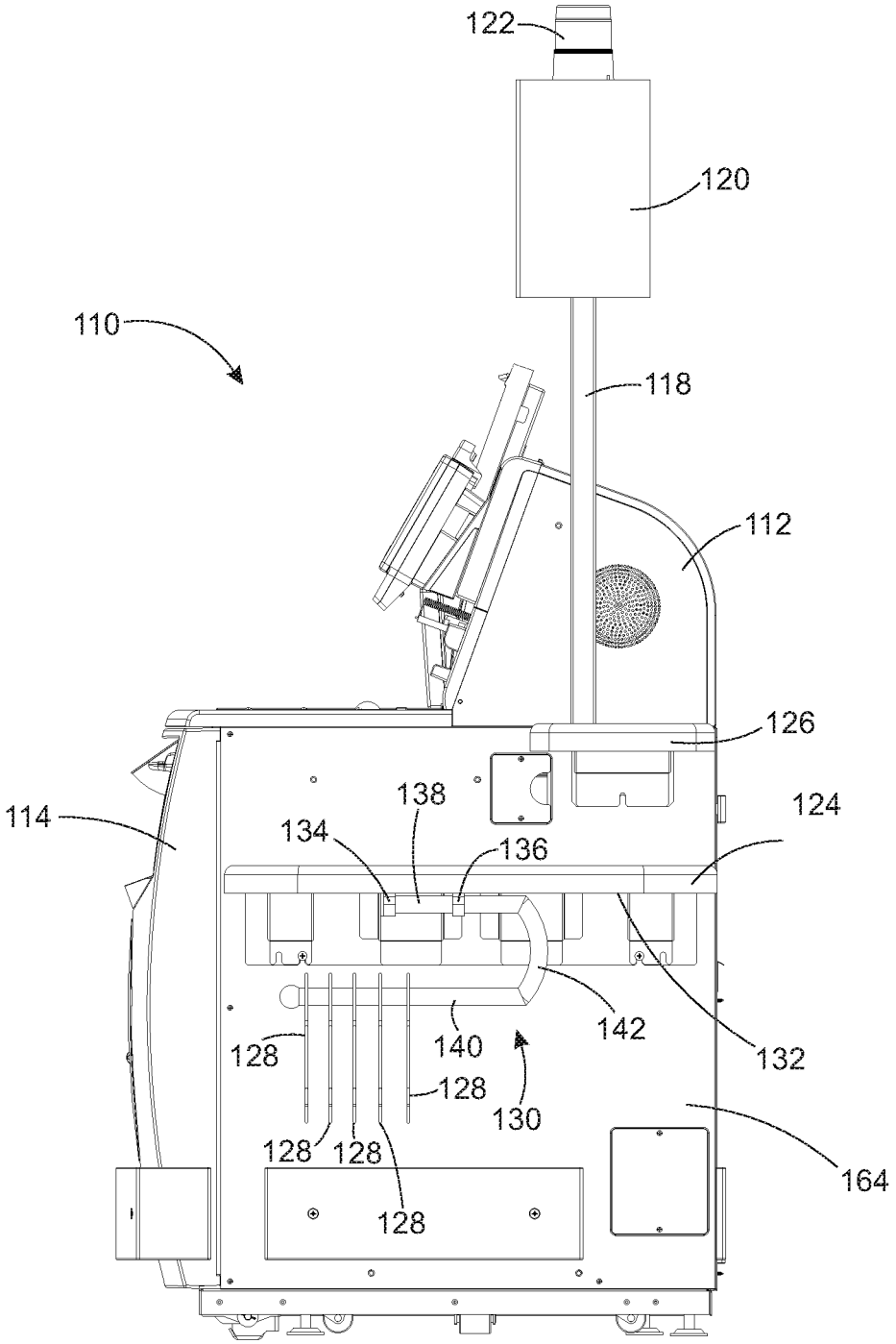
FIG. 2 shows a side view of the checkout station of FIG. 1 that includes the hook for receiving hangers.
Figure 3:
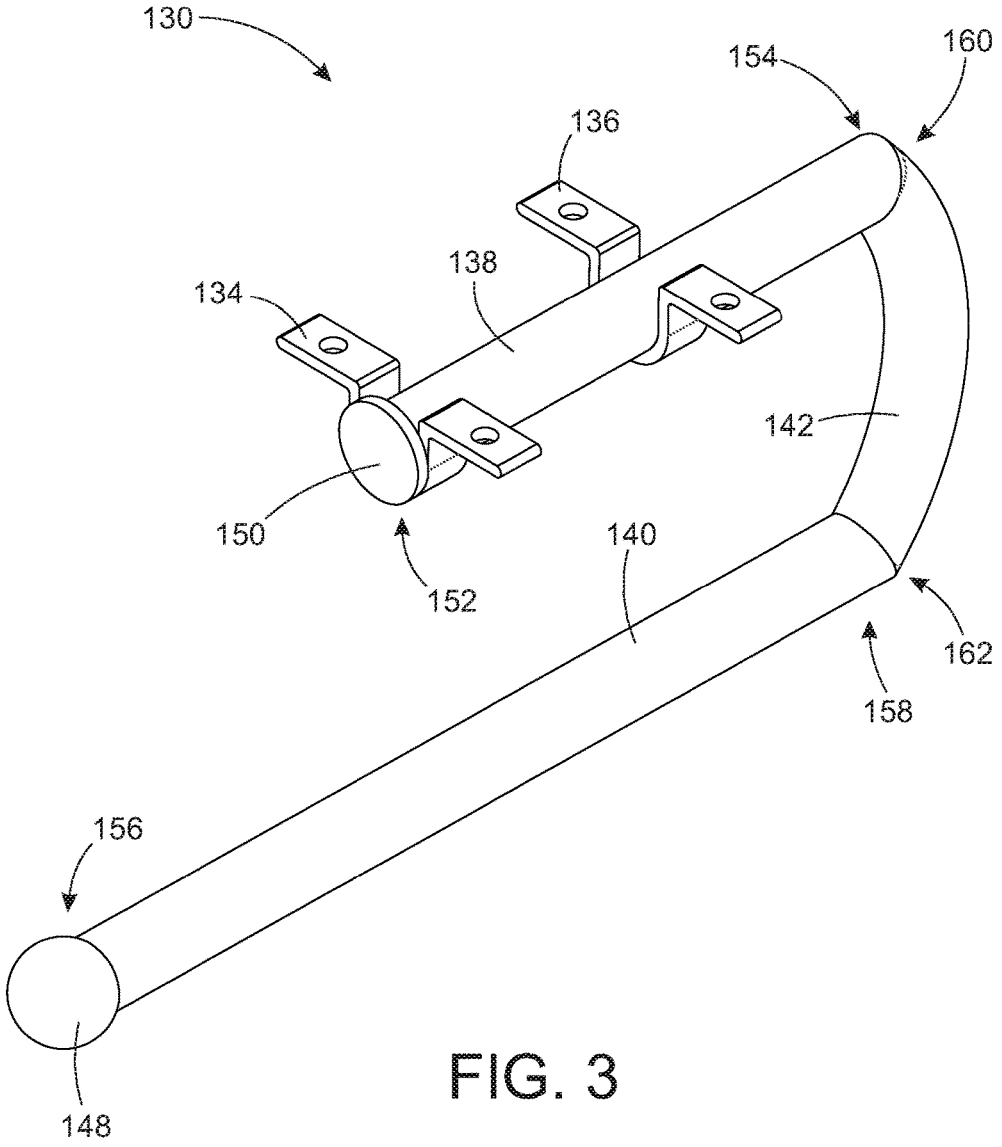
FIG. 3 shows a perspective view of an embodiment of a U-hook.
Figure 4:
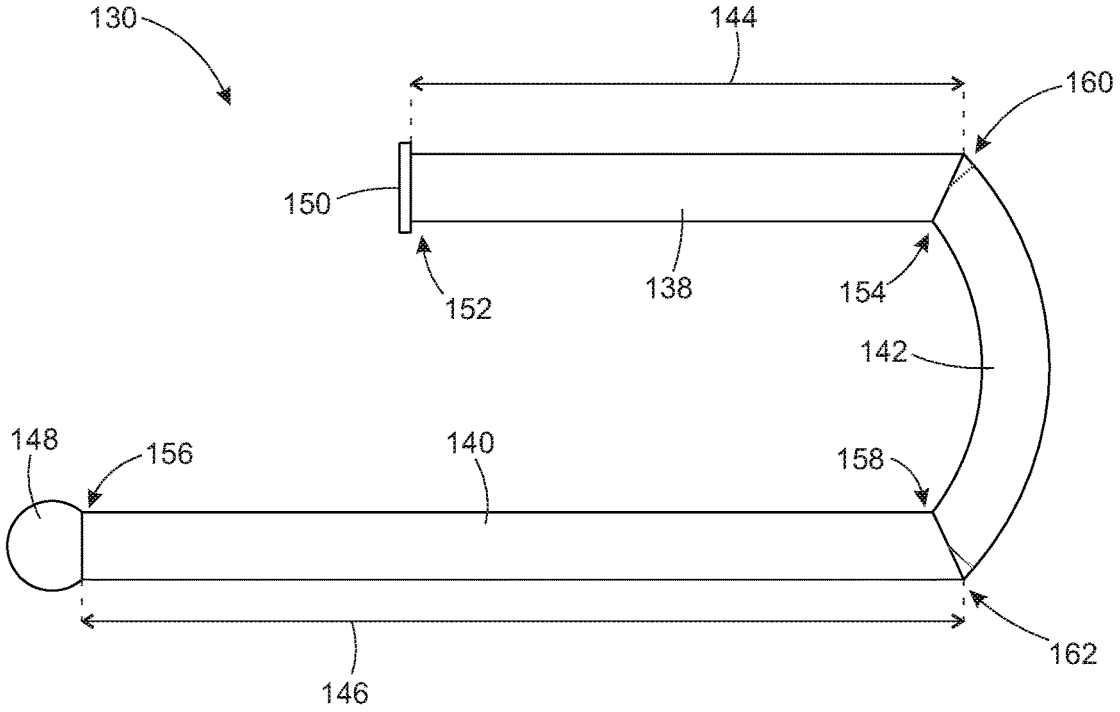
FIG. 4 shows a side view of the U-hook of FIG. 3.

FIG. 1 and FIG. 2 show an embodiment of a checkout station 110 with a U hook 130 for collecting hangers. FIG. 1 shows a front view of checkout station 110. FIG. 2 shows a side view of checkout station 110. FIGS. 3 and 4 show details of U hook 130. FIG. 3 shows a perspective view of U hook 130. FIG. 4 shows a side view of U hook 130.

Checkout station 110 shown in FIG. 1 and FIG. 2 is a self-checkout station in this embodiment, but this is not meant to be limiting. U hook 130 can be used at any checkout station, including self-checkout stations or employee-run checkout stations. Any checkout station where hangers of any type may need to be collected can use U hook 130. U hook 130 is one embodiment of a hanger hook, but this is not meant to be limiting. Any type of hook that can hold hangers, such as but not limited to, a J hook, a V hook, or any other hook that can hold hangers, can be substituted for U hook 130.

Checkout stations are places in a retail store where purchases are paid for and bagged. Products hung on hangers are often removed from the hanger at the checkout station so that it is more convenient for the product to be folded and carried home. Hangers tend to build up at checkout stations and cover table surfaces or platforms, or end up on the ground, which can make the checkout station look unkempt and can be dangerous if customers or employees trip or slide on hangers. It is desirable to have a device at each checkout station for collecting hangers.

Checkout station 110 includes a checkout register 112. Checkout register 112 is used to document items purchased and add up the total cost of the purchases. Checkout register 112 sits on a register stand 114. Register stand 114 is used to support checkout register 112. Register stand 114 in this embodiment in on wheels, but this is not meant to be limiting. Register stand 114 has a register stand first side 164 and a register stand second side 166, as shown in FIG. 1 and FIG. 2. Checkout station 110 also includes a scale 116. Scale 116 is used to weigh purchases so that the retail store can verify that all items in the bags have been entered into checkout register 112. Scale 116 is coupled to register stand second side 166. A light pole 118 is coupled to register stand 114. Light pole 118 holds a light fixture 120 with a light emitter 122. Light fixture 120 and light emitter 122 are used to emit light that can provide an indication of the status of the checkout station, or provide other light-based communications.

Checkout station 110 includes two platforms 124 and 126 coupled to register stand 114. Platforms 124 and 126 can be used for many different purposes, but are often used as a place for customers to set a purse or wallet, for example, or a place for a customer to use as a surface for writing a check. Platforms 124 and 126 are coupled to register stand first side 164, in this embodiment.

It is to be understood that checkout station 110 is only an example of one embodiment of a checkout station used in retail stores, and that U hook 130, or a different embodiment of a hanger hook, can be used at any type or configuration of checkout station.

Checkout station 110 includes a hanger hook coupled to platform 124. In this embodiment, the hanger hook is U hook 130 coupled to a bottom surface 132 of platform 124. U hook 130 is a hanger hook for receiving at least one hanger 128. Hangers of many types can be hung on U hook 130. A number of clothes hangers 128 are shown hanging from U hook 130, but it is to be understood that many different types of hangers can be hung from U hook 130. U hook 130 receives at least one hanger 128. Hanger 128 is stored on U hook 130 until hanger 128 is collected for re-use or disposal. U hook 130 provides a convenient location for hanging at least one hanger 128. U hook 130 is a means for collecting hangers 128. U hook 130 collects hangers 128 so that hangers 128 do not pile up on platforms 124 or 126, or end up on the floor. In some embodiments, a hanger hook other than U hook 130 is used in place of U hook 130. U hook 130 can be replaced with any hanger hook that can hold hangers, such as a J hook, a V hook, or any other hanger hook. In some embodiments, U hook 130, or a different type of hanger hook, is coupled to register stand 114 instead of platform 124. In some embodiments, U hook 130, or a different type of hanger hook, is coupled to other parts of checkout station 110.

Checkout station 110 also includes a first strap 134 and a second strap 136. First strap 134 and second strap 136 are a means to couple U hook 130 to platform 124 and register stand 114 of checkout station 110. In this embodiment, first strap 134 and second strap 136 are a first and a second means to couple U hook 130 to platform 124 and register stand 114 of checkout station 110. First strap 134 and second strap 136 are strips of metal or other rigid or semi-rigid material formed into a shape that will couple U hook 130 to bottom surface 132, as shown in FIG. 2 and FIG. 3. In this embodiment, each of first strap 134 and second strap 136 are formed to include a u-shaped portion that wraps around U-hook 130, with a tab at either end of the u-shaped portion. The tabs at either end couple to platform 124. First strap 134 and second strap 136 in this embodiment are screwed into bottom surface 132 through holes in first strap 134 and second strap 136, but this is not meant to be limiting. Many different types of couplers can be used as a means to couple U hook 130 to bottom surface 132 of platform 124.

FIG. 3 and FIG. 4 shows details of U hook 130. U hook 130 is a U-shaped elongate member with a first side 138, a second side 140, and a bottom piece 142. Bottom piece 142 forms the bottom of the "U" shape of U hook 130. Bottom piece 142 is curved, as shown in FIG. 3 and FIG. 4. Bottom piece 142 couples first side 138 to second side 140. Bottom piece 142 has a bottom piece first end 160 and a bottom piece second end 162 opposing bottom piece first end 160.

First side 138 is formed of a first elongate member having a first side first end 152 and a first side second end 154 opposing first side first end 152. First side 138 is straight and tubular in shape, meaning first side 138 has a circular cross-section. First side second send 154 is coupled to bottom piece first end 160, as shown in the figures. First side 138 is a first side of the "U". First side 138 is coupled to bottom surface 132 with straps 134 and 136 in this embodiment, but this is not meant to be limiting. In some embodiments, second side 140 is coupled to bottom surface 132. In some embodiments, first side 138 of U hook 130 is coupled to register stand 114 in a location other than bottom surface 132 of platform 124. First side first end 152 has a disk shaped end piece 150 coupled to it. Disk shaped end piece 150 is a round flat disk that protects first side first end 152 and helps to make sure first side first end 152 does not cause damage to people, or structures.

Second side 140 is formed of a second elongate member having a second side first end 156 and a second side second end 158 opposing second side first end 156. Second side 140 is straight and tubular in shape. Second side 140 has a circular cross-section. Second side second end 158 is coupled to bottom piece second end 162, as shown in FIG. 4. Second side 140 is a second side of the "U" shape of U hook 130. Second side 140 is the portion of U hook 130 that hangers 128 are hung on, in this embodiment, but this is not meant to be limiting. In some embodiments, second side 140 is coupled to register stand 114 or platform 124, and first side 138 receives hangers 128. Second side 140 has a spherical shaped end piece 148 coupled to second side first end 156. Spherical shaped end piece 148 protects second side first end 156, ensures that second side first end 156 does not cause damage to people or fixtures, and provides for a smooth surface to hold hangers 128 on second side 140 but still allows hangers 140 to be put on and taken off of second side 140 easily and quickly.

In the embodiment of U hook 130 shown in the figures, first side 138 is shorter than second side 140, as shown in FIG. 4. First side 138 has a length 144. Second side 140 has a length 146. Length 146 is longer than length 144 in this embodiment. Having first side 138 be shorter than second side 140 allows second side 140 to extend out further than first side 138 so that hangers 128 can be easily put on and taken off of second side 140 without having first side 138 getting in the way. First side 138 and second side 140 are parallel to each other, in this embodiment.

Bottom piece 142 is formed of a third elongate member having bottom piece first end 160 and bottom piece second end 162 opposing bottom piece first end 160. Bottom piece 142 is tubular in shape with a circular cross-section. Bottom piece 142 is curved in this embodiment. Bottom piece first end 160 is coupled to first side second end 154. Bottom piece second end 162 is coupled to second side second end 158, as shown in FIG. 3 and FIG. 4.

Figure 5:
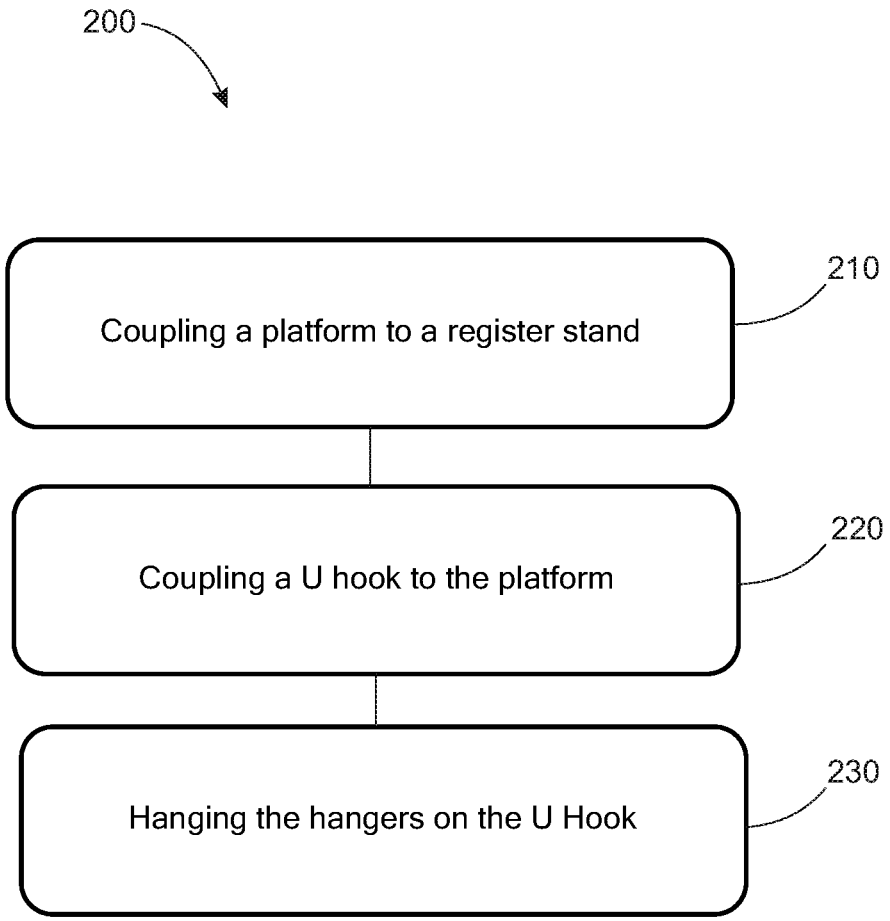
FIG. 5 illustrates a method of storing hangers at a checkout station.

FIG. 5 illustrates a method 200 of storing hangers at a checkout station of a retail store. Method 200 includes an act 210 of coupling a platform to a register stand. The register stand is the part of the checkout station that supports the register. In some embodiments, the platform is coupled to other portions of the checkout station.

Method 200 also includes an act 220 of coupling a hanger hook to the platform. In some embodiments, a first side of the hanger hook is coupled to the platform, where the first side is shorter than a second side of the hanger hook. In some embodiments, the hanger hook is coupled to the platform of the register stand with at least one strap. In some embodiments, the hanger hook is coupled to the platform of the register stand with two straps. In some embodiments, the hanger hook is coupled to a bottom surface of the platform.

Method 200 also includes an act 230 of hanging the hangers on the hanger hook. The hangers can be clothes hangers or any other type of hanger. In some embodiments, the hangers are hung on a second side of the hanger hook, where the first side is coupled to the register stand. The hangers are hung on the hanger hook until they are collected.

Hanging the hangers on the hanger hook keeps the hangers from taking up space on the register stand or the platform, or from ending up on the floor.

In some embodiments, method 200 includes coupling a first side and a second side to a bottom piece to form the hanger hook. In some embodiments, the hanger hook is an elongate member formed into a "U" shape. The bottom piece is curved and forms the bottom of the "U". The first side and the second side are straight, in this embodiment, and form the two sides of the "U". In this embodiment, the first side is shorter than the second side, but this is not meant to be limiting. The shorter first side is coupled to the register stand in this embodiment so the hangers can be put on and taken off of the second side of the hanger hook without the first side getting in the way. In some embodiments, method 200 includes coupling a disk end piece to a first side first end of the hanger hook. In some embodiments, method 200 includes coupling a spherical end piece to a second side first end of the hanger hook.

A checkout station with a hanger hook for receiving hangers has been shown and described. Hangers tend to build up at checkout stations because they are removed from clothes or other items being purchased and need to be kept somewhere until they are re-used or discarded. Hangers are set on surfaces of the checkout station and get in the way of checkout activities. Alternatively, they can end up on the floor, where they can be a danger to customers or employees. The disclosed hanger hook receives empty hangers and keeps the hangers in a convenient place until the hangers are collected. In some embodiments, the hanger hook is a U-shaped elongate member with a curved bottom piece, and a first and a second straight side piece, each coupled to the curved bottom piece to form the "U" shape. A first side of the U-shaped hanger hook is coupled to a platform of the checkout station. A second side of the U hook receives the hangers.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A checkout station comprising:

register stand;

a user interface attached to an upper portion of the register stand;

a platform coupled to a side of the register stand at a level below the user interface, wherein the platform has a top surface and a bottom surface; and a U hook coupled to the bottom surface, wherein the U hook comprises:

a first side comprising a first elongate member having a first side first end and a first side second end opposing the first side first end, wherein the first side is coupled to the bottom surface using a first strap and a second strap;

a second side comprising a second elongate member having a second side first end and a second side second end opposing the second side first end;

a bottom piece comprising a third elongate member having a bottom piece first end coupled to the first side second end and a bottom piece second end coupled to the second side second end; and at least one empty hanger, wherein the second side of the U hook receives the at least one empty hanger, and wherein the second side of the U hook collects and stores the at least one empty hanger.

2. The checkout station of claim 1, wherein the first side is shorter than the second side.

3. The checkout station of claim 2, wherein the first side, the second side and the bottom piece each have a circular cross section.

4. The checkout station of claim 3, wherein the bottom piece is curved, and wherein the first side and the second side are straight.

5. The checkout station of claim 4, wherein the first side and the second side are parallel to each other.

6. The checkout station of claim 4, wherein the U-hook further comprises:

a disk shaped end piece coupled to the first side first end; and a spherical shaped end piece coupled to the second side first end.

7. The checkout station of claim 1, wherein the platform is coupled to a register stand first side, and a scale is coupled to a register stand second side.

8. The checkout station of claim 7, wherein the platform is a first platform, and wherein the checkout station further comprises a second platform coupled to the register stand first side.

* * * * *